US006536631B1

(12) United States Patent
Nickels et al.

(10) Patent No.: US 6,536,631 B1
(45) Date of Patent: Mar. 25, 2003

(54) SEALED FLUID DISPENSING DEVICE

(76) Inventors: Jean-Charles Nickels, 14, rue du Moanda, F-95270 Luzarches (FR); Colette Schnerb, 6 rue du Loing, F-75014 Paris (FR)

( * ) Notice: Subject to any disclaimer, the term of this patent is extended or adjusted under 35 U.S.C. 154(b) by 0 days.

(21) Appl. No.: 09/699,671

(22) Filed: Oct. 26, 2000

Related U.S. Application Data

(63) Continuation of application No. PCT/FR99/01023, filed on Apr. 29, 1999.

(51) Int. Cl.[7] ..... B65D 37/00

(52) U.S. Cl. ..... 222/212; 222/213; 222/494; 604/247

(58) Field of Search ..... 222/212, 213, 222/215, 494; 604/132, 142, 247

(56) References Cited

U.S. PATENT DOCUMENTS 1,987,156 A * 1/1935 Paparello ..... 221/60
2,026,012 A * 12/1935 Anderson ..... 221/60
3,506,163 A * 4/1970 Rauh et al. ..... 222/212
3,877,619 A * 4/1975 Chavez, Jr. ..... 222/494
4,846,810 A * 7/1989 Gerber ..... 604/247
5,033,647 A * 7/1991 Smith et al. ..... 222/94
5,092,855 A * 3/1992 Pardes ..... 604/247
5,279,447 A * 1/1994 Petschek ..... 222/105
5,305,786 A * 4/1994 Debush ..... 137/512.3
5,836,484 A * 11/1998 Gerber ..... 222/494
6,116,465 A * 9/2000 Bouzaglo ..... 222/92
6,325,253 B1 * 12/2001 Robinson ..... 222/212

* cited by examiner

*Primary Examiner*—Henry C. Yuen
*Assistant Examiner*—Frederick Nicolas
(74) *Attorney, Agent, or Firm*—Schnader Harrison Segal & Lewis LLP

(57) ABSTRACT

A device for dispensing fluid including a pressure-operated reservoir and a dose-metering head communicating with the reservoir to permit at least partial flow of the fluid to at least one outlet opening, the head including a fixed body and a membrane which, when at rest, comes into surface contact with at least a part of the fixed body on which the membrane is tightly mounted, the outlet opening being provided on an external element, wherein tightening of the membrane, during pressure operation of the reservoir, permits a flow from the reservoir via a peripheral space delimited by the membrane and by the part of the fixed body and which forms a passage for the fluid to the outlet opening, and, in the absence of pressure on the reservoir, to permit the membrane to occupy an equilibrium position in which the membrane is in surface contact with the part of the fixed body, by the intermediary of a thin film of fluid, essentially closing off the passage for the fluid, which essentially tightens the communication between the outlet opening and the reservoir.

12 Claims, 2 Drawing Sheets

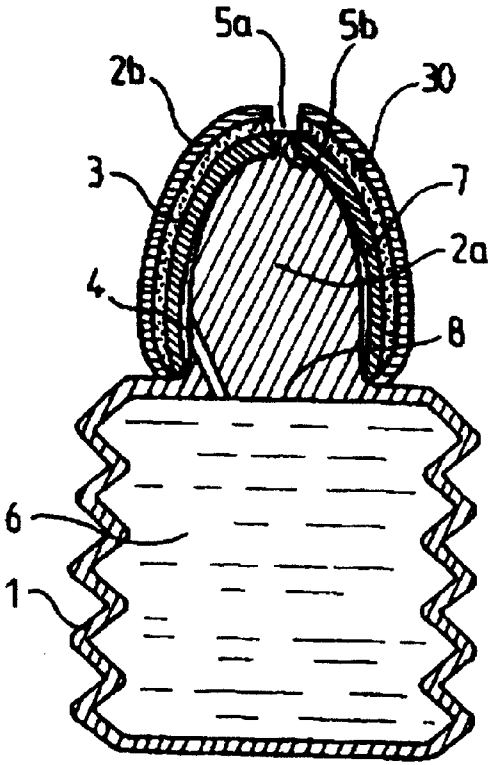
FIG.4
FIG.3
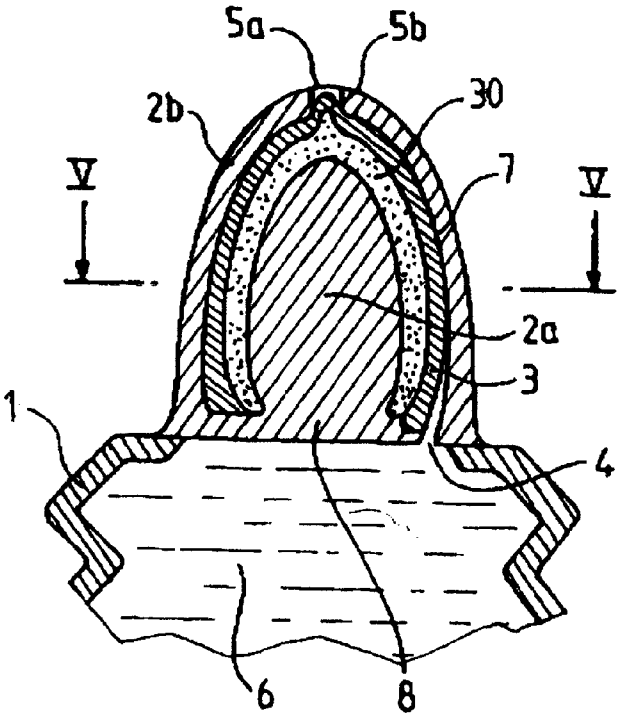
FIG.5
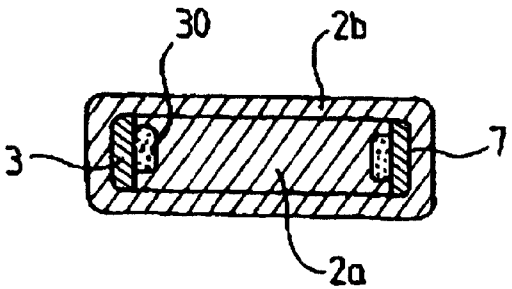

SEALED FLUID DISPENSING DEVICE

This is a continuation of International Application No. PCT/FR99/01023, with an international filing date of Apr. 29, 1999, which is based on French Patent Application No. 98/05394, filed Apr. 29, 1998.

The present invention concerns a hermetic device for the distribution of a fluid, especially a liquid substance and/or a paste, such as eye drops or other fluids for pharmaceutical or personal hygiene use (toothpaste, liquid soap, etc.), an alimentary fluid (milk, fruit juice, etc.) or a fluid for industrial use (lubricant, catalyst, polymerizable resin, etc.).

BACKGROUND

Fluids of the type mentioned above generally have a limited useful life after their package has been opened. In order to resolve this problem, a known solution is to package them for a single use in the form of a single-dose package. However, this solution increases the packaging cost in relation to the volume of fluid that it contains.

Another solution is to mix chemical preservatives with the fluid in order to protect it from the various pollutants (air, light, dust, bacteria, etc.) that could come into contact with the fluid. However, these preservatives can be dangerous and/or be disapproved of by certain users such that it is often desirable to not use them.

SUMMARY OF THE INVENTION

The goal of the present invention is to improve this situation.

The invention pertains to a fluid-dispensing device comprising a reservoir that can be operated by pressure, and a dose-metering head communicating with the reservoir so as to obtain an at least partial flow of the fluid to at least one outlet opening.

BRIEF DESCRIPTION OF THE DRAWINGS

Other advantages and characteristics of the invention will be perceived upon reading the description below which is presented as an example and the attached drawings in which:

FIG. 3 is a longitudinal sectional view of a fluid-dispensing device comprising a reservoir fitted with an appendage and a membrane in contact with an internal wall of a rigid shell which comprises this appendage according to a more complex form of implementation of the previously mentioned second mode of implementation;

FIG. 4 is a longitudinal section view of a fluid-dispensing device according to a more complex form of implementation of the previously mentioned first mode of implementation; and FIG. 5 is a cross sectional view along line V—V of FIG. 3 of a variant of the dispensing device shown in FIG. 3.

DETAILED DESCRIPTION OF THE INVENTION

Figure 2:
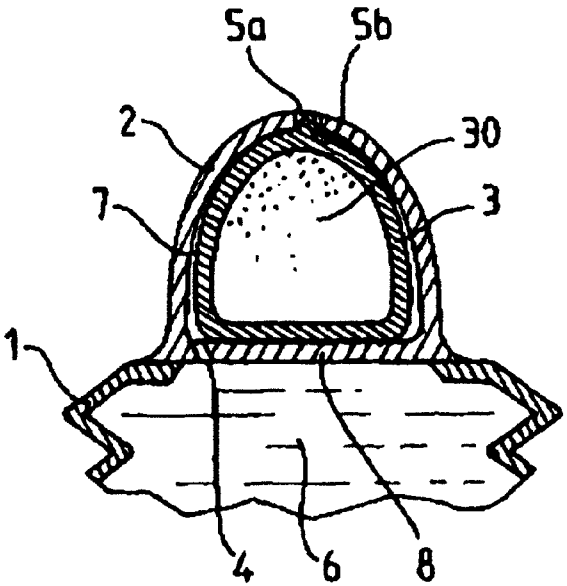
FIG. 2 is a longitudinal sectional view of a fluid-dispensing device comprising a reservoir fitted with a fixed body (or appendage) and a membrane in. contact with an internal wall of this appendage according to a second mode of implementation of the present invention.

The description below and the attached drawings essentially contain characteristic elements. They can thus not only provide better comprehension of the invention but also contribute as needed to its definition.

According to a general definition of the invention, the head comprises a fixed body and a membrane mounted in a tight manner on at least part of the fixed body. The tightening of the membrane is selected:

- on the one hand, so as to allow—during pressure operation of the reservoir—a flow from the reservoir via a peripheral space which is delimited by the membrane and by said part of the fixed body and which forms a passage for the fluid to the outlet opening, and
- on the other hand, so as to allow the membrane—in the absence of pressure on the reservoir—to occupy an equilibrium position in which it is in surface contact with said part of the fixed body, essentially closing off the passage for the fluid.

One of the advantages derived from the present invention is that—in the membrane equilibrium position—a thin film of fluid remains trapped between the membrane and the previously mentioned part of the fixed body. This film, in combination with the sealing by the membrane of the inlet and outlet openings of the previously mentioned peripheral space, makes it possible to essentially make tight th communication between the outlet of the resevoir.

According to another advantageous characteristic of the present invention, the fixed body is of essentially convex form and comprises a base which is interdependent with the reservoir and fitted with at least one channel which communicates with the reservoir on the one hand and the peripheral space on the other hand.

According to a first preferred mode of implementation of the present invention the, membrane envelopes the external surface of the previously mentioned part of the fixed body, and comprises the outlet opening. The apex of the convexity of the fixed body can close the outlet opening while the membrane, in its equilibrium position, also envelopes the base of the fixed body so as to close the communication between the channel and the peripheral space.

In this first mode of implementation, the fixed body preferably comprises a part of essentially solid convex form (or, in a variant, hollow but closed in its upper part) provided with at least one channel communicating on the one hand with the reservoir and on the other hand with the peripheral space.

According to an optional advantageous characteristic of the invention, the membrane is essentially of pocket form and comprised of a light compressed material so as to maintain the external surface of the membrane in surface contact with the previously mentioned part of the fixed body.

In a more complex variant of the previously mentioned first mode of implementation the fixed body also comprises a rigid shell that can cover the membrane and which is fitted with said outlet opening.

The membrane is preferably interdependent with an internal surface of the rigid shell and comprises an opening created so as to communicate with the outlet opening. The previously mentioned peripheral space is thus delimited by the membrane and by the solid convex part of the fixed body.

In contrast to the first mode of implementation of the present invention, in which the previously mentioned part of the fixed body is always of essentially convex form, in a second mode of implementation this part is hollow so as to essentially house the membrane. Thus, the relative positions of the membrane and the fixed body are reversed in relation to their positions in the first mode of implementation. The membrane is in contact with an internal surface of the fixed body and the outlet opening is created essentially at the apex of convexity of the fixed body. Because of its inherent elasticity and/or a light compressed material which it can contain, the membrane exerts a pressure on the internal wall of the fixed body from the interior toward the exterior.

Figure 1:
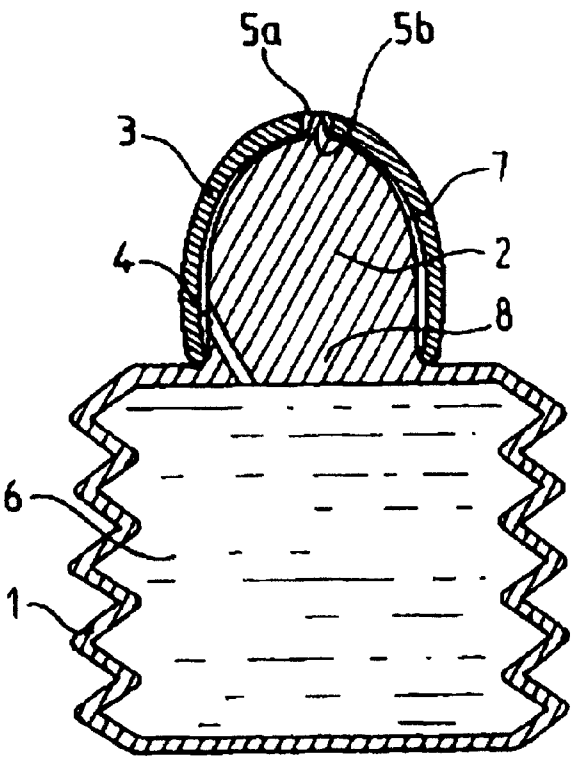
FIG. 1 is a longitudinal sectional view of a fluid-dispensing device comprising a reservoir fitted with a fixed body (or appendage) and a membrane in contact with the external surface of this fixed body according to the previously mentioned first mode of invention.

In a more complex variant of the second mode of implementation, the fixed body has a solid convex part and the membrane is interdependent with this solid convex part. In this case, the peripheral space is delimited by the membrane and by an internal surface of the previously mentioned rigid shell. Thus, in this variant, the membrane does not have any openings.; and Reference will first be made to FIG. 1, in which is shown a reservoir 1 fitted with an interdependent appendage 2. This reservoir 1 has an oblong form which is essentially a hollow cylinder. It is preferentially made of a ductile material, for example polyvinyl chloride. It thus can be operated by pressure, especially manual pressure. In order to facilitate this pressure, it also has concentric crimps which form bellows as shown in FIG. 1.

The reservoir 1 has an interdependent appendage 2 which comprise a single integral part in the example described. As variants, the appendage can be made interdependent with the reservoir 1 by means of screws, snap fasteners or by gluing.

The appendage 2 is of essentially solid ogival-cylindrical form in the example described. It comprises a base 8 by means of which it is interdependent with the reservoir 1. The base 8 is traversed by a channel 4 which communicates with the reservoir 1. In addition, this channel 4 extends to the external surface of the appendage 2.

In a variant, the appendage 2 has a hollow dome form fitted near its base with an opening forming the previously mentioned channel 4.

The dispensing device according to the invention comprises a membrane 3 made at least in part of an elastic material. The membrane is mounted tightly against the appendage 2 such that in the resting position this membrane 3 is in surface contact with the appendage 2.

According to the previously mentioned first mode of implementation, the membrane 3 is in contact with the external surface of the appendage 2. The membrane is fixed close to the base 8, essentially under the channel 4. In practice, it is fixed between the appendage 2 and the reservoir 1. The membrane tightly envelopes the appendage 2 while remaining interdependent with the base 8, thereby covering the opening which forms the channel 4 on the surface of the appendage 2. The fixation of the membrane 3 can be implemented via gluing or heat sealing, or by mechanical support (locking rings, screws, snap fasteners, etc.). The membrane 3 is fixed in a manner such that the space between the membrane and the base 8 is tight along the length of its periphery.

The membrane 3 has an opening 5*a* positioned essentially at the apex of the appendage 2. The apex of the appendage 2 preferably has a protuberance 5*b* which comes to coincide essentially with the orifice 5*a*. This protuberance 5*a* comes to be inserted in the opening 5*a* so as to close the opening 5*a* when the membrane 3 is in a resting position.

When the reservoir 1 is operated by pressure, the fluid 6 enters into the channel 4. The membrane 3, which is advantageously elastic in the vicinity of this channel 4, extends itself laterally so as to form a passage for the fluid 6 between the internal surface of the membrane 3 and the external surface of the appendage 2. The peripheral space 7 delimited by the respective surfaces of the appendage 2 and the membrane 3—which space communicates with the channel 4—thus forms a passage for the fluid 6. The membrane 3 is subjected to a push towards the exterior which is essentially normal at its surface. As a result, at the high part, the opening 5*a* of the elastic membrane extricates itself from the protuberance 5*b*, thereby allowing discharge of the fluid under pressure.

The elasticity of the membrane 3 is selected so as to allow a flow via the channel 4, via the peripheral space 7 and then via the opening 5*a*. The opening 5*a* is preferably of a form selected such that the flow of the fluid is essentially unidirectional. For example, the opening 5*a* can be in truncated conical form with the apex of the cone facing the top of FIG. 1.

Upon cessation of the pressure on the reservoir 1, the elasticity of the membrane 3 tends to return said membrane to its resting position. The resultant elastic return movement, combined if necessary with the aspiration effect of the reservoir 1, causes part of the fluid 6 lying in the peripheral space 7 to back-flow towards the channel 4. The membrane 3, returning to its resting position, closes the previously mentioned opening of the channel 4. The part of the fluid 6 which is not re-aspirated but remains in the peripheral space 7 continues to be pushed towards this opening 5*a* until the periphery of the opening 5*a* is placed on the homologous part of the appendage 2. In the example described, this homologous part corresponds essentially to the protuberance 5*b*.

In the example, the membrane is made of an e lastic material such as natural rubber or a suitable synthetic material, for example an elastomer of suitable elasticity.

In a variant, only part of the membrane 3 is made of an elastic material of the previously mentioned type, while another part of the membrane is made of a relatively rigid material such as polyvinyl chloride. This different part can then form a rigid band or a rigid cap covering part of the appendage 2.

Reference will now be made to FIG. 2 in order to describe a dispensing device according to the previously mentioned second mode of implementation of the present invention. In FIG. 2, the body of the reservoir 1 is not shown in its entirety. It can be understood that its form corresponds essentially to that shown in FIG. 1.

In this second mode of implementation, the relative positions of the appendage and the membrane are reversed.

The appendage 2 is still of an essentially convex form (ogival-cylindrical in the example described) but it is hollow in accordance with this second mode of implementation. It is made of a rigid material such as polyvinyl chloride, preferably of small thickness, and has a base 8 fixed to the reservoir 1. This fixation can be implemented by mechanical means such as screws or snap fasteners or by gluing. The channel 4, which communicates with the reservoir 1, traverses the base 8 of the appendage 2. In this second mode of implementation, the opening 5*a* is now located at the apex of the appendage 2.

The membrane 3 is housed inside the appendage 2 in contact with its internal surface. The membrane is implemented in the form of a pocket containing a light material 30 compressed so as to maintain, in the resting position, its external surface in forced contact with the internal surface of the appendage 2. In practice, it contains a gas under pressure, such as nitrogen, or a compressed flexible foam (for example, expanded polyurethane) or a compressible gel (for example, a silicone gel).

As a variant, the membrane can be of solid form and made of a flexible elastic material. In both cases, the compression of the membrane results from the fact that its initial dimensions (membrane not constrained) are greater than the dimensions of its housing formed by the cavity of the hollow appendage, or due to the fact of a subsequent expansion.

In another variant of this second mode of implementation, the membrane is of an elasticity selected (essentially more rigid) so that it can maintain itself against the internal surface of the hollow appendage.

The membrane 3 advantageously has a protuberance 5*b* created so as to insert itself in the opening 5*a* in the appendage 2. When the membrane 3' is in a resting position, this protuberance 5*b* blocks the opening 5*a*.

When the reservoir 1 is subjected to external pressure, the fluid 6 flows in the channel 4. The fluid 6 penetrating into the peripheral space 7, delimited on the one hand by the internal surface of the appendage 2 and on the other hand by the external surface of the membrane 3, pushes back the membrane 3 laterally. The fluid thus flows from the channel 4 all the way to the opening 5*a*, moving in the peripheral space 7. The fluid 6 finally pushes back the membrane's protuberance 5*b* in the example described and flows from the opening 5*a*.

Advantageously, the elastic membrane 3, which in the example described comprises a light compressed material, closes in the resting position the opening formed by the channel 4 in the base 8 of the appendage 2. In addition, the membrane's protuberance 5*b* in the resting position closes the opening 5*a* which is located in the hollow appendage 2 in this second mode of implementation.

In a variant of this second mode of implementation, part of the membrane 3 is made of an essentially rigid material such as polyvinyl chloride and forms a rigid band or cap.

Thus, in this second mode of implementation, the hollow appendage 2 plays the role of a rigid shell protecting the membrane 3.

Reference will now be made to FIG. 3 in order to describe a more complex form of implementation of the fluid-dispensing device shown in FIG. 2. In this form of implementation, the dispensing head of the device comprises a solid appendage 2*a*. (or, in a variant, it is hollow but closed at its top part) on which is mounted in an interdependent manner a membrane 3 created in the form of a pocket containing a light compressed material 30 of the previously described type. Specifically, the dispensing head comprises a rigid shell 2*b* which caps the appendage 2*a* and the membrane 3. This rigid shell is provided with an outlet opening 5*a* in its top part and the membrane 3 has a protuberance 5*b* which is introduced into the opening 5*a* in an equilibrium position of the membrane (in the absence of pressure actuation on the reservoir 1). Finally, there is provided in the base of the appendage 2*a*, common with a base of the rigid shell 2*b*, a channel 4 communicating with the reservoir. Specifically, this channel 4 communicates on the one hand with the reservoir 1 and on the other hand with an interface (or peripheral space) 7 between an external surface of the membrane 3 and an internal surface of the rigid shell 2*b*.

Thus, when pressure is applied to the reservoir 1, the fluid 6 transported by the channel 4 penetrates into the interface 7 (peripheral space between the membrane 3 and the rigid shell 2*b*) until the point where it is discharged from the opening 5*a* of the rigid shell 2*b*, while the protuberance 5*b* of the membrane 3 subjected to the pressure exerted by the fluid 6, particularly on the light material 30 that it contains, retracts towards the interior of the dispensing head.

In this form of implementation the flow rate of the fluid distributed by the head of the device is advantageously selected as a function of:

the elasticity of the membrane 3, the compressibility of the light compressed material 30 contained in the membrane 3, and the dimensions of the interface between the external surface of the solid appendage 2*a* and the internal surface of the rigid shell 2*b*.

The membrane 3 is therefore, preferably, of different elasticity from the base 8 to the outlet opening of the dispensing head. The design in effect is such that the device according to the invention has a membrane of selected profile (essentially thicker or more resilient in the vicinity of the base 8) so as to obtain a differentiated tightening in the dispensing head, with a pressure to which the fluid 6 is subjected which is greater at the base 8 than at the outlet opening 5*a*. In practice, such a membrane 3 profile can be obtained by molding or by cutting from an elastic-material of the previously mentioned type which is suitable for this profile.

As a variant, one can inject into the membrane 3, as compressed material 30, materials of different comprehensibilities with the less compressible materials being at the base of the dispensing head.

Thus, a thin film of fluid remains in the vicinity of the outlet opening of the device according to the invention, while an even thinner film of fluid advantageously tightens the interface between the fixed body and the membrane 3, which makes it possible to eliminate or, at least, minimize contamination by air of the fluid in the reservoir 1.

FIG. 5 shows a form of implementation of the device represented in FIG. 3, in which the dispensing head is of essentially flat general form in the extension of the reservoir 1. The rigid shell 2*b* and, particularly, the solid appendage 2*a* present flattened ogival flattened forms on two lateral faces which are parallel and symmetrical with respect to the axis of the ogive.

In this case the membrane is made in the form of a band containing a light compressed material. In particular, a groove is provided on the periphery of the solid appendage 2*a* to house the material 30 which the membrane 3 contains. This membrane is made interdependent via its ends with the edges of the peripheral groove of the appendage 2*a*. When subjected to the pressure exerted by the light material 30, the membrane 3 is brought into surface contact with a peripheral internal wall of the rigid shell 2*b*.

In the example shown in FIG.,3, the solid part 2*a* of the appendage has a single channel 4. In practice, it is preferably provided with two essentially symmetrical channels both of which communicate on the one hand with the reservoir 1 and on the other hand with the peripheral space 7 in the vicinity of the base 8, which enables an essentially symmetrical flow of the fluid in the dispensing head of the device. In a variant which consists of providing a membrane 3 created in the form of a band which extends essentially from the base 8 to the outlet opening 5*a* of the device, a single channel 4 can possibly be provided in the solid part of the appendage 2*a*.

Reference will now be made to FIG. 4 in order to describe a hybrid variant of the forms of implementation shown in FIGS. 1 and 3, in which the relative positions of the membrane 3 and the light compressed material 30 that it contains are reversed with respect to the implementation shown in FIG. 3. Thus, in this variant, the external surface of the membrane 3 is in surface contact with the internal solid appendage 2*a* which is provided with a channel which communicates on the one hand with the reservoir 1 and on the other hand with the interface (or peripheral space) 7 between the membrane 3 and the appendage 2*a*. In addition, in this variant, the membrane is interdependent with the internal surface of the rigid shell 2*b*. In addition, the membrane 3 is provided with an opening which communicates with the opening 5*a* of the rigid shell while the solid appendage 2*a* has a protuberance 5*b* which comes to coincide, in the equilibrium position of the membrane 3, with the opening in this membrane.

Thus, upon application of pressure to the reservoir 1, the fluid 6, transported by the channel 4, penetrates into the interface (or peripheral space) 7 between the membrane 3 and the solid appendage 2*a*, up to the opening 5*a* of the rigid shell 2*b*, while the membrane 3 is retracted against the rigid shell 2*b* so as to form a passage for the fluid 6.

In addition the dispensing device according to the invention can be fitted with a protective cap (not shown) of hollow form for essentially covering the membrane and/or the appendage 2. The dispensing device according to the invention in addition has a security seal which ensures that the cap has remained closed prior to the initial use.

Thus, the provision of an elastic membrane in a dispensing device according to the invention assures on the one hand the tightness of the previously mentioned opening of the channel 4 and on the other hand the tightness of the opening 5*a* when the reservoir 1 is not subjected to external pressure (membrane 3 in resting position). Because the membrane 3 essentially hugs the form of the fixed body, it is also possible to ensure, in the resting position, a tightness of the passage for fluid which is defined by the peripheral space 7. The trajectory of the fluid 6 from the reservoir 1 all the way to the opening 5*a* is thereby protected from any penetration of the external environment and thus from any pollution from this environment.

It is obvious that the present invention is not limited to the forms of implementation described above as examples. The invention extents to other variants.

Thus, it is understood that the dispensing head can have an essentially convex mobile insert rather than a fixed body (or appendage). This insert can, for example, be in the form of a ball which envelopes the elastic membrane 3. This ball would in this case rest on the external walls of the reservoir 1, in the manner of a ball resting on a bottle neck. Upon application of pressure on the reservoir, the pressure of the fluid slightly raises the ball. A passage of the fluid between the ball and reservoir then forms an equivalent of the previously mentioned channel 4. The fluid can then flow into the peripheral space delimited by the surface of the ball and the internal surface of the membrane 3. The fluid then would flow from the opening 5*a* of the membrane. Such a device would preferably have a return mechanism for the ball such as an elastic mechanism (spring) or a magnetic mechanism (a magnet, with the ball being made, for example, of iron) so as to facilitate the flow of the fluid 6 via the opening 5*a* of the membrane.

The concentric crimps presented by the reservoir 1 facilitate the exertion by a user of manual pressure. However, more simply, the reservoir can be pear-shaped or in any other form as long as this form is hollow and the material of which it is constituted is ductile.

The form of the appendage 2, which is shown as essentially ogival-cylindrical in FIGS. 1 and 2, was described above as an example. In fact, the appendage 2 can have a different form, although preferably convex, so as to advantageously enable almost total surface contact of the membrane 3 with the appendage 2.

The appendage 2 (the membrane 3) has at its apex a protuberance 5*b* in the first (second) mode of implementation described above. This protuberance 5*b* is essentially of an optional nature and can be eliminated in a different form of implementation of the present invention.

In the first mode of implementation described above, the appendage 2 is of essentially convex solid form. In a variant, this form can be hollow. The appendage in that case has a base 8 which is interdependent with the reservoir 1 and is traversed by at least one channel 4 communicating on the one hand with the reservoir and on the other hand with the peripheral space 7. Preferentially, the channel 4 traverses the base 8 without communication with the interior of the appendage 2, which makes it possible to isolate the hollow interior of the appendage from any penetration of the exterior environment and/or the fluid 6.

In addition, in the first and second modes of implementation described above, the base 8 of the appendage 2 has a single channel 4 communicating with the reservoir 1.

Nevertheless, a larger number of channels can be envisaged so as to promote the flow of the fluid. In fact, there can be envisaged a number of channels that increases with the viscosity of the fluid. The number of openings 5*a* can also increase with the viscosity of the fluid, with these openings being provided essentially in a top part of the membrane 3 or the appendage 2, in the first or second modes of implementation, respectively. In contrast, in the case in which the fluid is a liquid of low viscosity, the provision of a single opening advantageously makes it possible to limit the risks of contamination of the fluid by the medium in which the exterior of the membrane or appendage lies.

In the forms of implementation shown in. FIGS. 1, 3 and 4, the solid appendages can, in respective variants, be hollow but only provided with an opening in the vicinity of their base so as to form a channel 4.

Finally, the reservoir 1 can be implemented in the form of a fluid 6 distribution line, for example to a downstream line of a fluid distribution circuit.

What is claimed is:

1. A device for dispensing fluid comprising:

a pressure-operated reservoir and a dose-metering head communicating with the reservoir to permit at least partial flow of the fluid to at least one outlet opening, the head comprising:

a fixed body and a membrane which, when at rest, comes into surface contact with an apex portion of the fixed body on which said membrane is tightly mounted, wherein tightening of the membrane, during pressure operation of the reservoir, permits a flow from the reservoir via a peripheral space delimited by the membrane and by said part of the fixed body and which forms a passage for the fluid to the outlet opening, and, in the absence of pressure on the reservoir, to permit the membrane to occupy an equilibrium position in which the membrane is in surface contact with said apex portion, essentially closing off the passage for the fluid, which essentially tightens the communication between the outlet opening and the reservoir.

2. The dispensing device according to claim 1, wherein the fixed body is essentially convex and has a base which is interdependent with the reservoir, with the body comprising at least one channel provided for communicating with the reservoir and the peripheral space.

3. The dispensing device according to claim 1, wherein said reservoir is a fluid distribution line.

4. The dispensing device according to claim 1, wherein the fixed body has an ogival form.

5. A device for dispensing fluid comprising:

a pressure-operated reservoir and a dose-metering head communicating with the reservoir to permit at least partial flow of the fluid to at least one outlet opening, the head comprising:

a fixed body and a membrane which, when at rest, comes into surface contact with an apex portion of the fixed body on which said membrane is tightly mounted, wherein tightening of the membrane, during pressure operation of the reservoir, permits a flow from the reservoir via a peripheral space delimited by the membrane and by said part of the fixed body and which forms a passage for the fluid to the outlet opening, and, in the absence of pressure on the reservoir, to permit the membrane to occupy an equilibrium position in which the membrane is in surface contact with said apex portion, essentially closing off the passage for the fluid, which essentially tightens the communication between the outlet opening and the reservoir, wherein the membrane fits tightly against the surface of the fixed body, and comprises said outlet opening, and, wherein an apex of the convexity of the fixed body essentially closes the outlet opening, while the membrane fits tightly against said base to close communication between the channel and the peripheral space.

6. The dispensing device according to claim 5, wherein the fixed body has a protuberance which may be inserted in the opening in the membrane.

7. The dispensing device according to claim 5, wherein the membrane is made, at least in part, of an elastic material, with the elastic portion being installed adjacent the base, and the membrane has a rigid complementary portion.

8. The dispensing device according to claim 6, wherein the membrane is made, at least in part, of an elastic material, with the elastic portion being installed adjacent the base, and the membrane has a rigid complementary portion.

9. A device for dispensing fluid comprising:

a pressure-operated reservoir and a dose-metering head communicating with the reservoir to permit at least partial flow of the fluid to at least one outlet opening, the head comprising:

a fixed body and a membrane which, when at rest, comes into surface contact with at least a part of the fixed body, wherein said part of the fixed body is essentially hollow and convex and essentially houses the membrane such that the membrane is in contact with an internal surface of the fixed body, while the outlet opening is provided essentially at an apex of the convexity of the fixed body, wherein tightening of the membrane, during pressure operation of the reservoir, permits a flow from the reservoir via a peripheral space delimited by the membrane and by said part of the fixed body and which forms a passage for the fluid to the outlet opening, and, in the absence of pressure on the reservoir, to permit the membrane to occupy an equilibrium position in which the membrane is in surface contact with said part of the fixed body, essentially closing off the passage for the fluid, which essentially tightens the communication between the outlet opening and the reservoir.

10. The dispensing device according to claim 9, wherein the membrane is a pocket and comprises a light compressed material to maintain the external surface of the membrane in surface contact with said part of the fixed body.

11. The dispensing device according to claim 10, wherein said pocket is made in the form of a band in contact with a peripheral surface of the fixed body.

12. A device for dispensing fluid comprising:

a pressure-operated reservoir and a dose-metering head communicating with the reservoir to permit at least partial flow of the fluid to at least one outlet opening, the head comprising:

a fixed body comprising an essentially solid and convex part which defines at least one channel passing therethrough and a membrane which, when at rest, comes into surface contact with at least a portion of the fixed body, wherein tightening of the membrane, during pressure operation of the reservoir, permits a flow from the reservoir via a peripheral space delimited by the membrane and by said fixed body and which forms a passage for the fluid to the outlet opening, and, in the absence of pressure on the reservoir, to permit the membrane to occupy an equilibrium position in which the membrane is in surface contact with said part of the fixed body, essentially closing off the passage for the fluid, which essentially tightens the communication between the outlet opening and the reservoir;

wherein said at least one channel of said fixed body communicates with the reservoir and the peripheral space;

wherein the fixed body has a rigid shell which caps the membrane and is fitted with said outlet opening, and wherein the membrane is interdependent with an internal surface of the rigid shell and has an opening which communicates with the outlet opening, while said peripheral space is delimited by the membrane and the solid convex part of the fixed body.

* * * * *